US006494138B1

(12) United States Patent
Göttling et al.

(10) Patent No.: US 6,494,138 B1
(45) Date of Patent: Dec. 17, 2002

(54) PRINTING UNIT

(75) Inventors: Josef Göttling, Friedberg (DE); Horst Dauer, Rohrbach (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/635,155

(22) Filed: Aug. 9, 2000

(30) Foreign Application Priority Data

Aug. 10, 1999 (DE) ..... 199 37 796

(51) Int. Cl.[7] ..... B41F 5/00
(52) U.S. Cl. ..... 101/479; 101/216; 101/247
(58) Field of Search ..... 101/181, 216, 101/218, 219, 247, 477, 479

(56) References Cited

U.S. PATENT DOCUMENTS

| | | | | | |
|---|---|---|---|---|---|
| 2,460,504 | A | * | 2/1949 | Huebner | 101/479 |
| 3,129,662 | A | * | 4/1964 | Pinkerton | 101/218 |
| 3,791,294 | A | * | 2/1974 | Skelding et al. | 101/181 |
| 4,413,541 | A | * | 11/1983 | Biggar, III | 101/247 |
| 5,485,782 | A | * | 1/1996 | Horst | 101/216 |
| 5,528,986 | A | * | 6/1996 | Andersson et al. | 101/479 |
| 5,771,804 | A | * | 6/1998 | Knauer et al. | 101/216 |
| 5,806,427 | A | | 9/1998 | Niemiro et al. | |
| 5,813,336 | A | * | 9/1998 | Guaraldi et al. | 101/218 |
| 5,868,071 | A | | 2/1999 | Niemiro et al. | |
| 5,943,955 | A | * | 8/1999 | Niemiro et al. | 101/216 |
| 6,085,650 | A | * | 7/2000 | Petersen | 101/247 |
| 6,227,110 | B1 | * | 5/2001 | Zlatin | 101/218 |

FOREIGN PATENT DOCUMENTS

| | | |
|---|---|---|
| DE | 94 21 112.4 | 6/1995 |
| DE | 195 34 651 A1 | 3/1997 |
| DE | 197 40 129 A1 | 3/1999 |
| DE | 198 05 898 A1 | 11/1999 |

* cited by examiner

*Primary Examiner*—Eugene H. Eickholt
(74) *Attorney, Agent, or Firm*—Cohen, Pontani, Lieberman & Pavane

(57) ABSTRACT

A printing unit is provided for a web fed printing machine having at least two cylinders where at least one of the cylinders is adjustable with respect to another of the cylinders; a machine frame having at least one load bearing wall arranged laterally beside an end of the cylinders; a drive motor corresponding to each cylinder; at least one guide element operably attached to the load bearing wall at a surface of the load bearing wall that runs perpendicular to a plane through the end faces of the cylinders; and a plurality of carriages attached to the guide element. At least one of the cylinders is connected to the carriages so that a distance from another of the cylinders can be adjusted.

33 Claims, 12 Drawing Sheets

129a
120a
129
120
130
124
121
128
b
125
122
131
126
123
132
127
123a
132a

PRINTING UNIT

BACKGROUND OF THE INVENTION

1. Field of the Invention

The invention relates to a printing unit for a web-fed rotary printing machine, having at least two printing-unit cylinders each having its own drive motor and of which at least one can be set linearly at a distance from the other by means of a carriage guide system on the machine frame.

2. Description of the Related Art

German Patent Application No. 195 34 651.3 discloses a printing unit of this type which has two frame walls running parallel to the end faces of the printing-unit cylinders. The printing-unit cylinders can be fitted with sleeves of different diameter, so that the length of the printed image can be changed. A carriage is provided on the frame walls on both sides of the cylinder to mount the ends of a printing-unit cylinder. The carriages can be adjusted by working cylinders operated with a pressurized means. This design has a relatively complicated structure.

SUMMARY OF THE INVENTION

The object of the present invention is to provide a simple, cost-effective structure for a generic printing unit.

A further object of the present invention is to provide a compact, space-saving structure for a printing unit.

The present invention is a printing unit for a web fed printing machine having at least two cylinders where at least one of the cylinders is adjustable with respect to another of the cylinders; a machine frame having at least one load bearing wall arranged laterally beside an end of the cylinders; a drive motor corresponding to each cylinder; at least one guide element operably attached to the load bearing wall at a surface of the load bearing wall that runs perpendicular to a plane through the end faces of the cylinders; and a plurality of carriages attached to the guide element. At least one of the cylinders is connected to the carriages so that a distance from another of the cylinders can be adjusted.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings embodiments of the present invention are shown in schematic form as follows.

DETAILED DESCRIPTION OF THE PRESENTLY PREFERRED EMBODIMENTS

Figure 1:
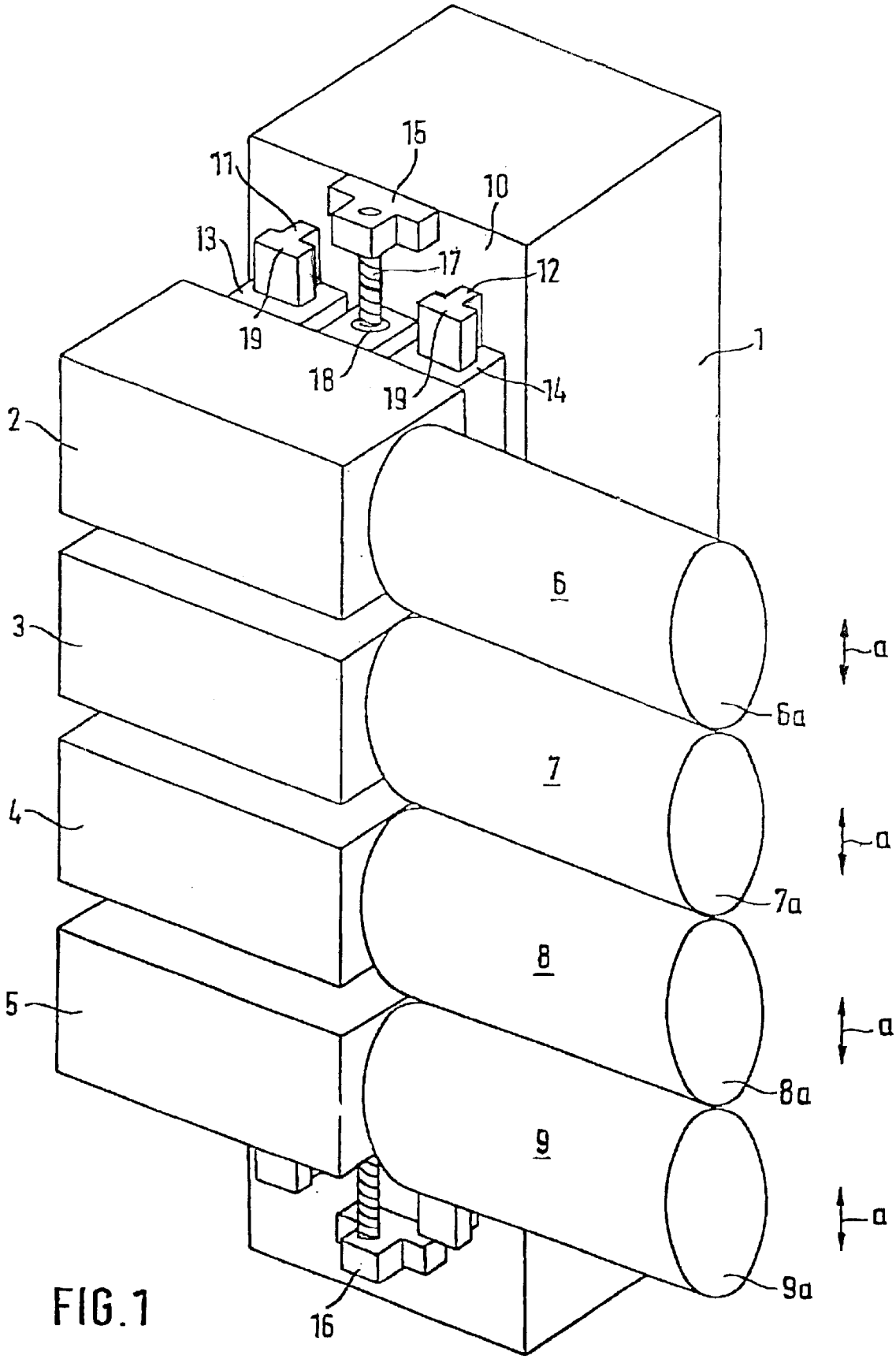
FIG. 1 is a perspective illustration of a double printing unit with cantilever-mounted printing-unit cylinders.

Referring now to FIG. 1 the printing of the present invention has a load bearing wall 1, on which identical carriages 2 to 5 are guided. Each carriage 2 to 5 carries a printing-unit cylinder 6 to 9 and accommodates a drive motor (not illustrated) for its printing-unit cylinder. In this case, the load bearing wall 1 is arranged laterally beside the ends 6*a* to 9*a* of the printing-unit cylinders 6 to 9. In order to guide the carriages 2 to 5, one wall side or surface 10 of the load bearing wall 1, which runs perpendicular to an imaginary plane drawn through the ends 6*a* to 9*a* of the printing-unit cylinders 6 to 9, bears two guide elements 11, 12, on which appropriately shaped sliding blocks 13, 14 of the carriages, e.g. 2, can slide. The guide elements 11, 12 are designed here as rails and are fixed to the wall surface 10 of the load bearing wall over their entire length. In order to prevent the carriages 2 to 5 from lifting off the load bearing wall 1, a form-fitting carriage guide system is provided. For this purpose, in the embodiment shown in FIG. 1, the guide elements 11, 12 have a T-shaped cross section. The main transverse part 19 of each guide element 11, 12 engages in an undercut groove in the sliding block 13 or 14. However, it is also possible to design the guide element as an undercut groove and then to provide the corresponding sliding block with a T-shaped cross section. Permanently arranged between an upper attachment 15 and a lower attachment 16 on the wall surface 10 is a bar-like guide element in the form of a screw spindle 17. Each of the carriages 2 to 5 bears a forward drive means, which comprises a driven wheel 18. If the wheel rotates, then the carriage, for example 2, with the printing-unit cylinder 6 moves in or counter to the direction of the arrow a. All the carriages have a box-like housing, which encloses the installed parts. The particular structure of this device is described in FIG. 3. A printing unit of this type is, for example, suitable for printing on both sides of a printing-material web in offset printing or indirect gravure printing. In this case, the printing-unit cylinders 6 and 9 form the plate cylinders bearing the image to be printed, and the printing-unit cylinders 7 and 8 form transfer cylinders, which transport the image to be printed onto the printing-material web (not shown) passing between the cylinders 7 and 8.

By moving carriage 2 upward and carriage 5 downward, the printing-unit cylinders 6 and 9 can be lifted off the printing-unit cylinders 7 and 8, so that it is possible to change printing-unit cylinders or sleeves stretched over the latter. By appropriately moving the carriages 3 and 4 over a smaller distance than the carriages 2 and 5, the printing-unit cylinders 7 and 8 can also be separated from each other, so that here, too, an approximately sleeve-like cover can be changed. In this case, it is possible to use printing-unit cylinders or sleeves of different diameter or different thicknesses as well.

In order to set printing on, the printing-unit cylinders 6 to 9 can be moved toward one another by predetermined distances defined as a function of the thickness of the printing-material web. Alternatively, it is also possible to use the force for pressing the individual cylinders towards one another as a measure of the mutual setting. This can be done, for example, by changing the torque of the drive motor for the wheel 18. Both possibilities benefit from the linear setting movements of the printing-unit cylinders 6 to 9.

Figure 2:
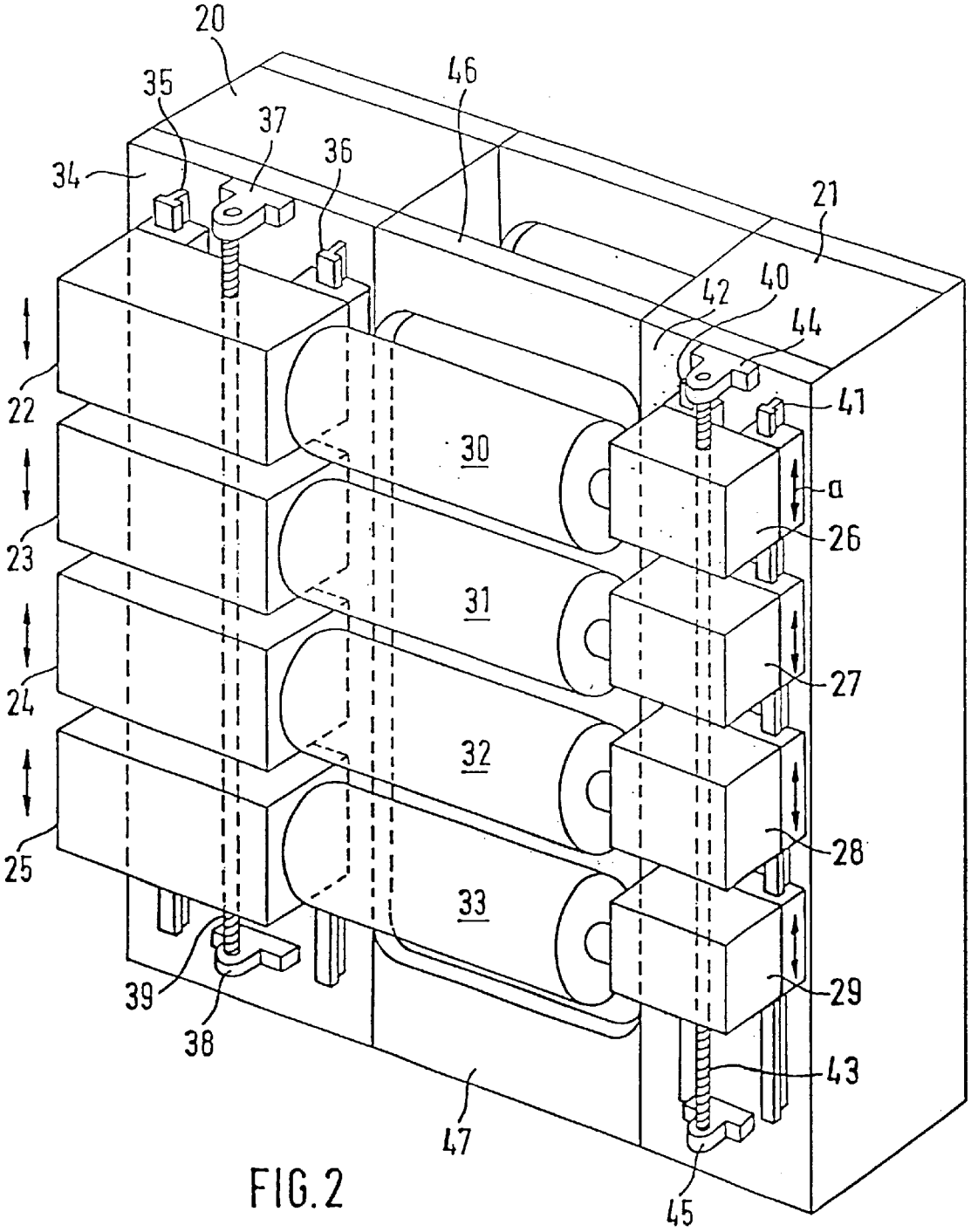
FIG. 2 is a perspective illustration of a double printing unit with two-sided mounting of the cylinders.

FIG. 2 shows a double printing unit having two load bearing walls 20, 21. The load bearing wall 20 is again assigned four carriages 22 to 25, and the load bearing wall 21 is assigned four carriages 26 to 29. Arranged between the carriages 22 and 26 is a printing-unit cylinder 30, which is mounted at both ends on different carriages. Accordingly, a printing-unit cylinder 31 is mounted between carriages 23 and 27, a printing-unit cylinder 32 is mounted between carriages 24 and 28, and a printing-unit cylinder 33 is mounted between carriages 25 and 29. In order to guide the carriages 22 to 25, two guide elements 35, 36 with a T-shaped cross section, which engage in corresponding undercut grooves on the carriages, are fitted to a wall surface 34 of the load bearing wall 20 which runs perpendicular to an imaginary plane drawn through the ends of the printing-unit cylinders 30 to 33. In addition, the wall surface 34 again bears two attachments 37, 38, between which a screw spindle 39 forming a rod-like guide element is permanently arranged. The screw spindle, which is indicated only schematically, cooperates with a forward drive means, which is not illustrated but is described below, on each of the carriages 22 to 25. Each of the carriages 22 to 25 in turn accommodates a drive motor for the associated printing-unit cylinder.

On the load bearing wall 21, two guide elements 40, 41 having a T-shaped cross section are likewise fitted to a wall surface 42 running parallel to wall surface 34. Also permanently fitted to this wall surface is a rod-like guide element designed as a screw spindle 43 between two attachments 44, 45. The screw spindle 43 also cooperates with a forward drive means, which is not illustrated but is described below, on each of the carriages 26 to 29. In the embodiment illustrated, the carriages 26 to 29 are designed to be smaller than the carriages 22 to 25, since they accommodate only the drive for the forward drive means, while the drive to the printing-unit cylinders 30 to 31 is provided only from the side of the carriages 22 to 25. However, it is also possible to design the carriages to be identical. In addition, it is possible to provide a drive motor for rotating the printing-unit cylinders 30 to 33 in the carriages 26 to 29. Here, the carriages 26 to 29 are designed in the manner of a tailstock and therefore have an axle journal which can be pulled back in order to mount one end of each printing-unit cylinder. In addition, the adjustment travel of the carriages 26 to 29, taking into account their height, that is to say their extent in the displacement direction a, is dimensioned to be greater than the maximum diameter of a sleeve to be used. Thus, by pulling back the axle journals and appropriately moving the carriages 26 to 29, it is possible for the ends of the printing-unit cylinders 30, 33 to be exposed, so that the sleeves bearing a printing image and belonging to these cylinders, or the cylinders themselves, can be replaced. Coupling devices which permit the axle journals to be pulled back are also described in the German Patent Application No. 197 40 129.5.

When each load-bearing device with the guide elements and the carriages are arranged beside one another in front of the ends of the printing-unit cylinders then the width of the printing unit may be kept low. In the arrangement according to FIG. 2, the load bearing walls 20, 21 are also connected to each other by means of upper connecting pieces 46 and lower connecting pieces 47 to form a portal. This achieves a machine frame of compact design which is both flexurally and torsionally rigid.

Figure 3:
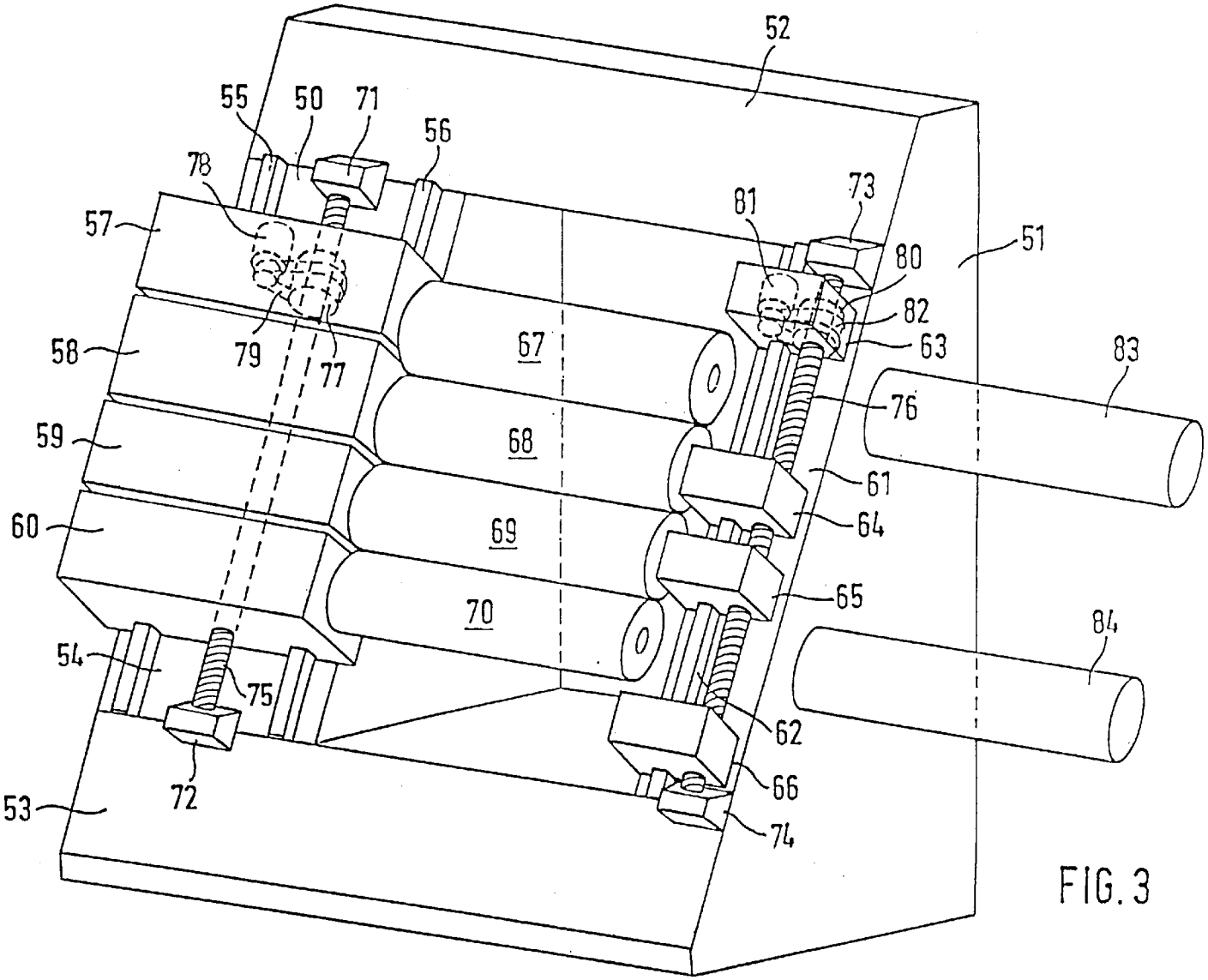
FIG. 3 is a perspective illustration of an inclined-bed machine with a screw drive for the carriages.

The printing unit according to FIG. 3 has two lateral load bearing walls 50, 51, which are connected to each other at the top and bottom by connecting pieces 52, 53 to form an inclined bed fitted on the front wall surface or part 54 of the load bearing wall 50, inclined and with respect to the horizontal, are two guide elements 55, 56 designed as in the embodiments according to FIG. 1 or 2. Box-like carriages 57 to 60 are guided on the guide elements 55, 56. Fitted to the front wall part 61 of the load bearing wall 51 is a guide element 62, on which carriages 63 to 66 are guided. Mounted on the carriages 57 to 60 and 63 to 66 are printing-unit cylinders 67 to 70. The carriages 57 to 60 each accommodate a drive motor (not illustrated) to rotate the cylinders 67 to 70. In this case, the inclinations of the walls 54 and 61 run perpendicular to an imaginary plane drawn through the end faces of the printing-unit cylinders 67 to 70 and parallel to a plane drawn through the axes A-A of the printing-unit cylinders 67 to 70.

Permanently fitted to the walls 54 and 61 by means of attachments 71, 72 and 73, 74, respectively, is a bar-like guide element designed as a screw spindle 75, 76. As FIG. 3 shows, the carriage 57 has a wheel 77 with a nut thread located at the center, in which the screw spindle 75 engages. The wheel 77 is mounted in the carriage 57 such that it can be rotated but is secured against axial displacement. Also accommodated in the carriage 57 is a setting motor 78, which has a drive connection, via a chain drive 79, to an external toothing system on the wheel 77. Instead of a chain drive, use could also be made of a belt drive with internal toothing. The setting motor 78 is designed as an electric motor. By this means, moving mechanical drive means between the load bearing wall 50 and the carriage 57 in order to transmit the setting movement are avoided. However, it is also possible to place a gearwheel onto the shaft of the setting motor 78, where the gearwheel cooperates directly with an external toothing system on the wheel 77. Instead of this screw drive described, a ball screw drive, a roller screw drive or a rolling-ring screw drive can also be used. In addition, the carriage 57 accommodates a drive motor (not shown) for the rotation of the printing-unit cylinder 67. A design that may be used here is described in German Patent document no. DE-C 196 24 394. The further carriages 58 to 60 have similar setting devices with a setting motor and a wheel provided with an internal nut thread on the screw spindle 75. In the same way, the carriage 63 accommodates a wheel 80 having an internal nut thread, which is mounted such that it can be rotated freely but is axially undisplaceable, and a setting motor 81, which once more are connected to one another via a chain drive 82. The carriages 64 to 68 are designed to be identical.

FIG. 3 shows the position of the printing-unit cylinders 67 to 70 in order to carry out a change of the sleeves 83, 84 bearing the printing image. While the carriages 57 to 60 are in the print-off position, in which the printing-unit cylinders 67 to 70 are lifted slightly off one another, the carriages 63 and 66 are each in their upper and lower end position, respectively. Access to one end of the printing-unit cylinders 67 and 70 is therefore free, so that the sleeves 83, 84 can be replaced. FIG. 3 reveals that one of the intermediate printing-unit cylinders 68, 69 could also be arranged to be non-adjustable.

Figure 4:
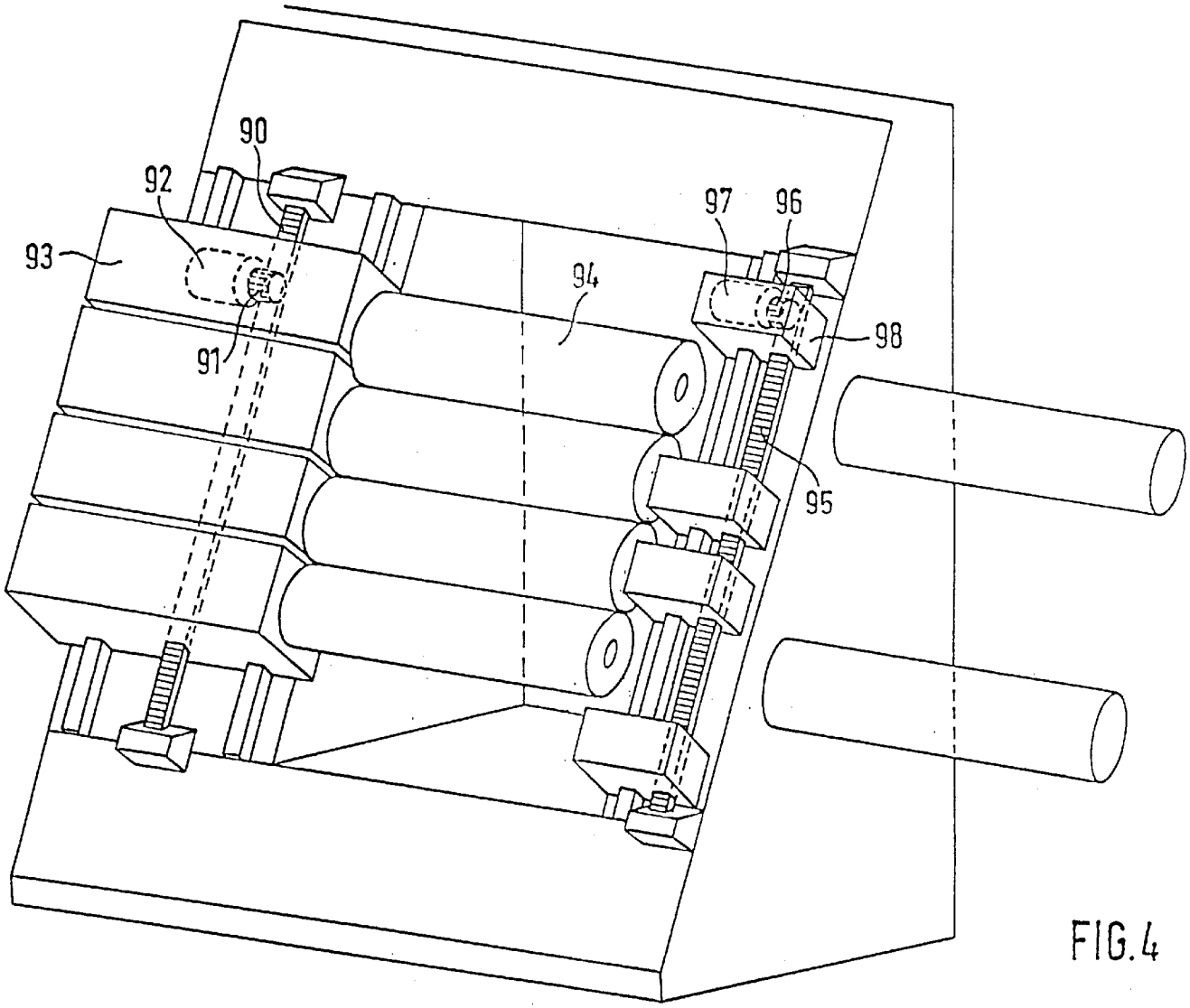
FIG. 4 is an illustration corresponding to FIG. 3 with a rack-and-pinion drive for the carriages.

The printing unit according to FIG. 4 differs from that according to FIG. 3 only in the use of other means for adjusting the carriages. Here, the rod-like guide element used is a permanently arranged rack 90. A pinion 91, which is fitted to the shaft of a setting motor 92, engages in the rack. The setting motor 92 is again permanently arranged in the carriage 93. In addition, this carriage 93 accommodates a drive motor for the rotation of the printing-unit cylinder 94. In the same way, a rack 95, in which a pinion 96 of a setting motor 97 engages, is permanently arranged in front of the other end of the printing-unit cylinder. The setting motor 97 and the pinion 96 are arranged in a carriage 98. The racks 90 and 95 are guided in recesses closed on all sides in the carriages 93 and 98 in such a way that the pinions 91, 96 always remain engaged with the racks 90, 95. The further carriages of the printing unit are of analogous design.

Figure 5:
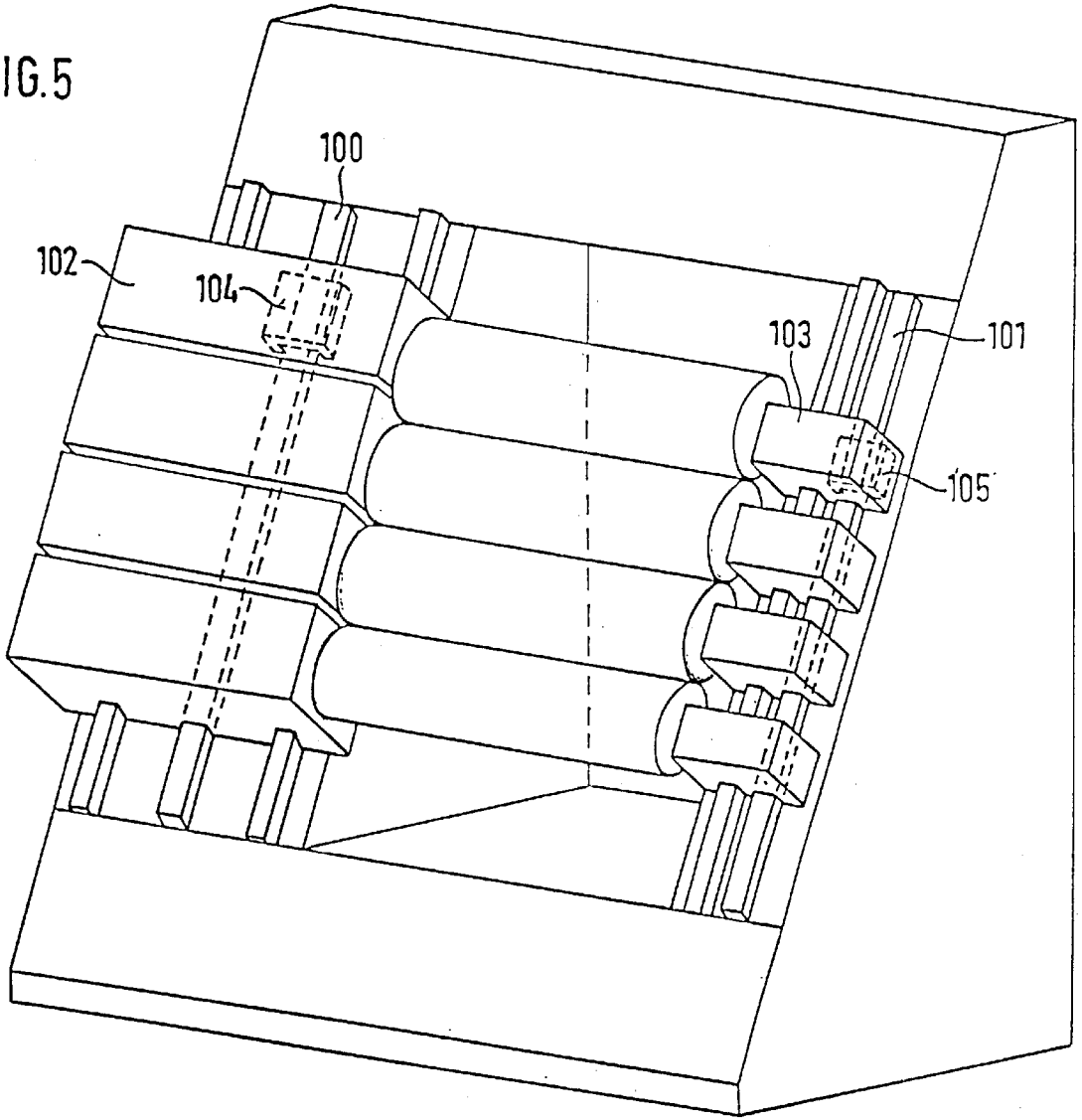
FIG. 5 is an illustration corresponding to FIG. 3 with a linear motor drive for the carriages.

The printing unit according to FIG. 5 also coincides with the printing unit according to FIG. 3, apart from the means for adjusting the carriages. Here, the rod-like guide element is designed as the secondary part 100 or 101 of a linear motor. A primary part 104 and 105, respectively, which forms the forward drive element and is permanently arranged in the carriage 102, 103, cooperates with the secondary part in order to displace the carriages.

Figure 6:
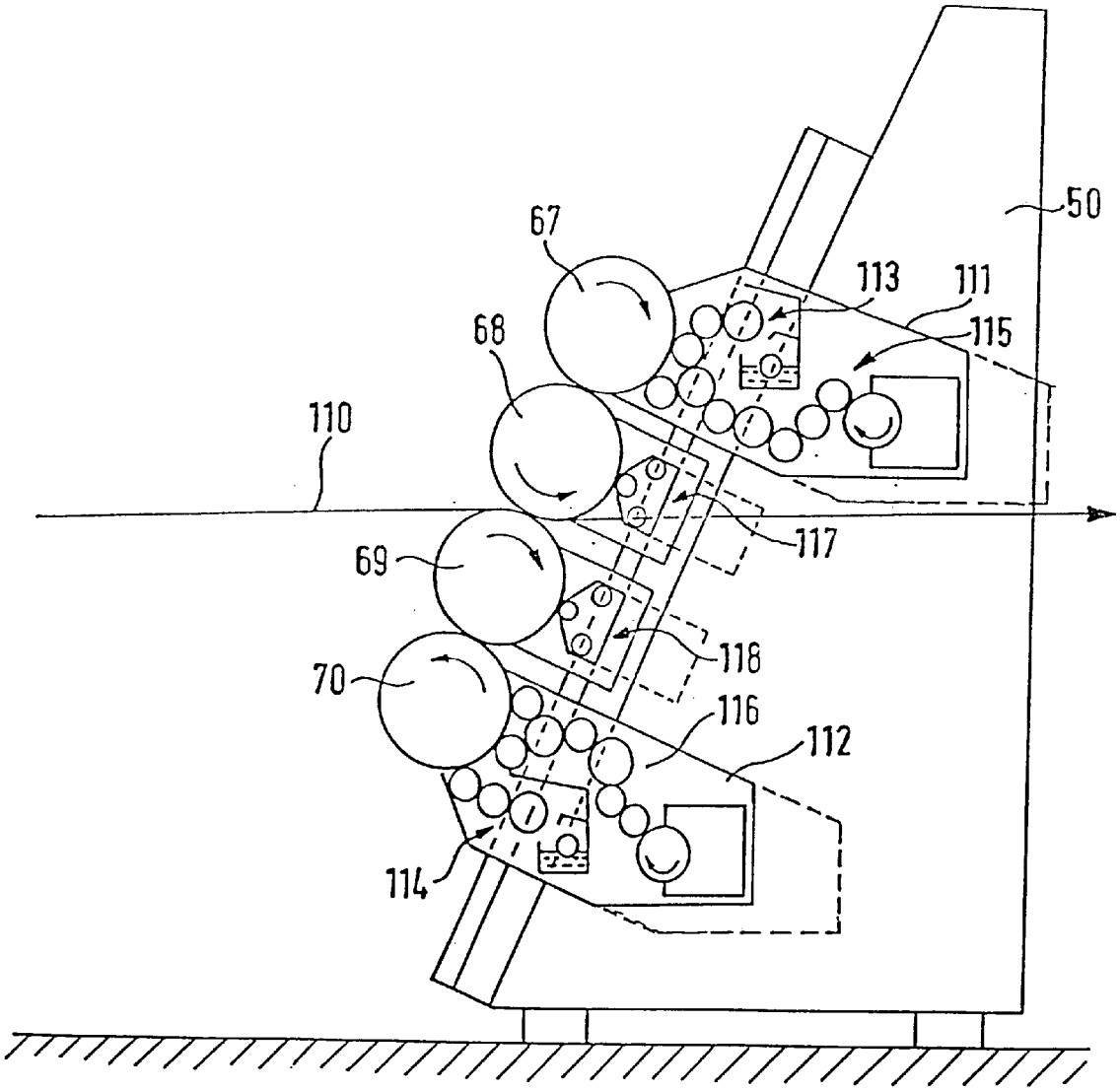
FIG. 6 is a vertical section through a double printing unit for offset printing.

FIG. 6 shows a further embodiment of a printing unit according to FIG. 3 in order to carry out printing on both sides of a printing-material web 106 in the offset process. Here, on the printing-unit cylinders 67, 70 designed as plate cylinders between the load bearing walls, of which only the load bearing wall 50 is illustrated, displaceably arranged withdrawable boxes 111, 112 are provided, each of which accommodates a damping unit 113, 114 and an inking unit 115, 116. In the position shown in FIG. 6, the inking and damping units are set onto the printing-unit cylinders 67, 70. The positions of the withdrawable boxes 111, 112 when the inking and damping units are removed are illustrated by dashed lines. Washing devices 117, 118 can be set onto the printing-unit cylinders 68, 69, acting as transfer cylinders, in the same way as the withdrawable boxes 111, 112, or can be lifted off these cylinders.

Figure 7:
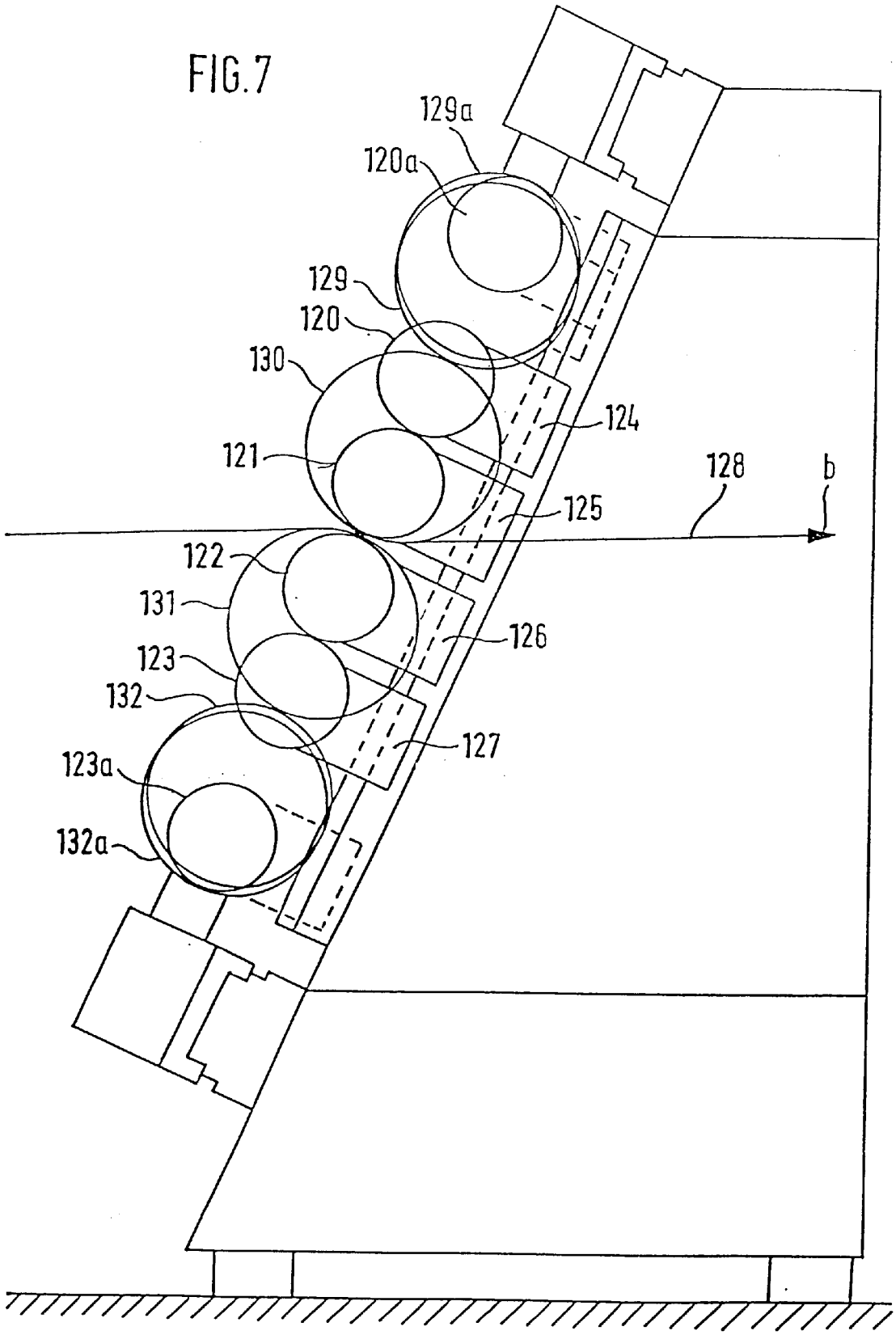
FIG. 7 is a vertical section illustrating the use of printing-unit cylinders of different sizes.

FIG. 7 shows the relationships when printing-unit cylinders of different size are being used. The reference symbols 120 to 123 are used to indicate the positions of the printing-unit cylinders with the smallest usable diameters and the associated positions of the carriages designated by the reference symbols 124 to 127. In this case, the printing-unit cylinders 120 and 123 are plate cylinders, and the printing-unit cylinders 121 and 122 are transfer cylinders of an offset printing unit. In this position as illustrated, the printing-material web 128 runs through in the direction of the arrow b between the cylinders 121 and 122 and, respectively, 130 and 131. In the process, it wraps around the printing-unit cylinder 121 or 130 to a greater extent in the outlet than the printing-unit cylinder 122 or 131. Uncontrolled, relatively long adherence of the web partially to one and partially to the other of the printing-unit cylinders 121, 122 is avoided, as a result of the oblique position of the plane drawn through the axes of the printing-unit cylinders 121 and 122 in relation to the plane of the printing-material web.

The reference symbols 120*a* and 123*a* are used to designate the possible end positions of the printing-unit cylinders 120 and 123 in the position for changing sleeves or cylinders. In this position, the printing unit cylinders 121 and 122 are also set apart from one another, but this is not illustrated for purposes of clarity.

The reference symbols 129 to 132 are used to illustrate the printing-unit cylinders of greatest diameter provided for use in the print-on position. In this case, too, the printing-unit cylinder 130 acting as a transfer cylinder is wrapped around to a greater extent by the outgoing printing-material web 128 than the printing-unit cylinder 131. 129*a* and 132*a* show the position of these cylinders in the print-off position. The position of the printing-unit cylinders 130 and 131, which in this position are lifted slightly off each other, is likewise not specifically illustrated in the drawing for purposes of clarity.

Figure 8:
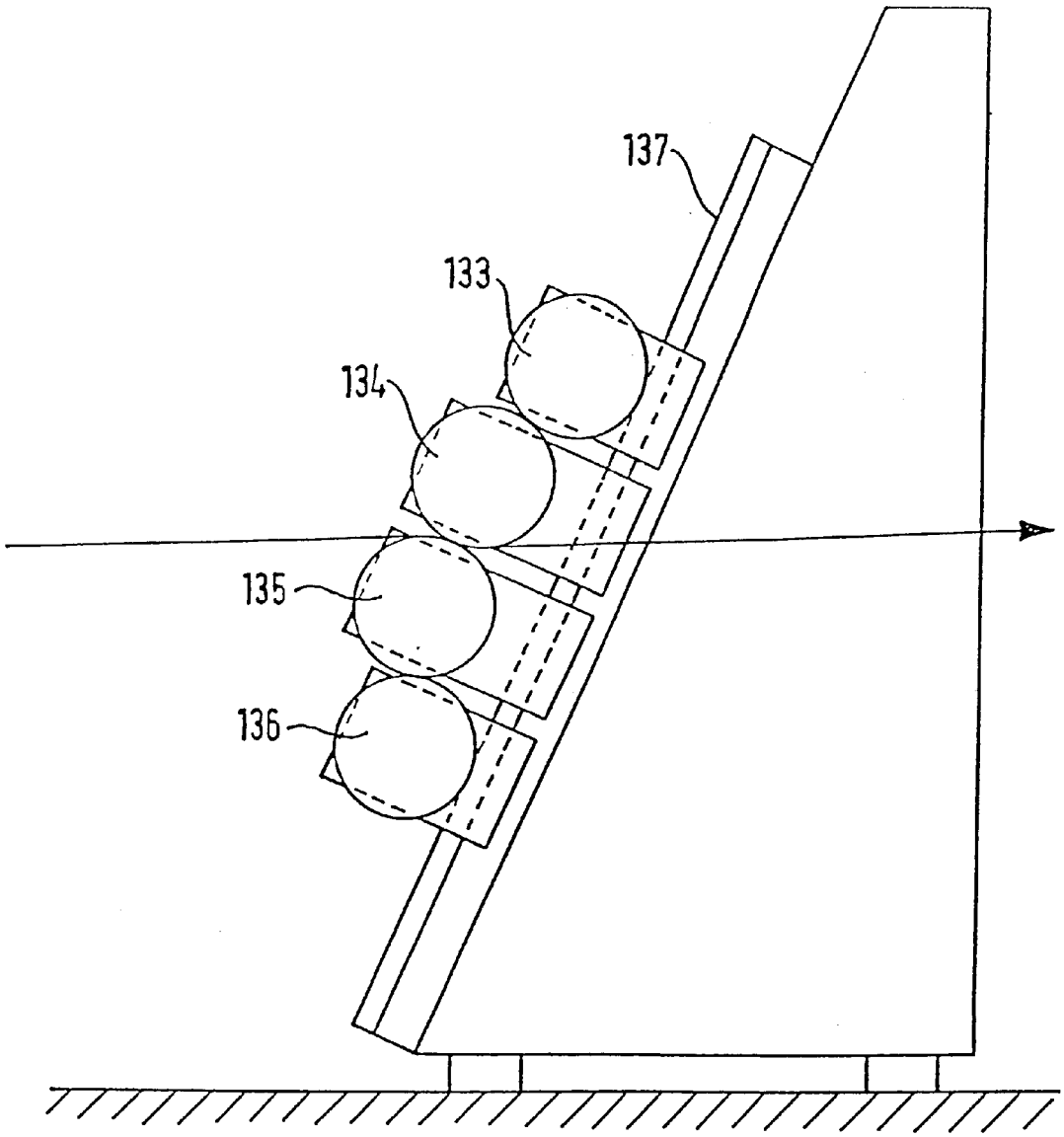
FIG. 8 is a section through a double printing unit with cylinders offset parallel to the axis.

FIG. 8 indicates that the axes of the printing-unit cylinders do not have to lie in one plane. Here, the printing-unit cylinders 133 and 134 and the printing-unit cylinders 135 and 136 are offset in relation to one another. The printing-unit cylinders 134, 135 can also be offset. This is expedient in particular when the guide elements 137 run vertically, in order once again to achieve a greater wrap around one of the intermediate printing-unit cylinders.

Figure 9:
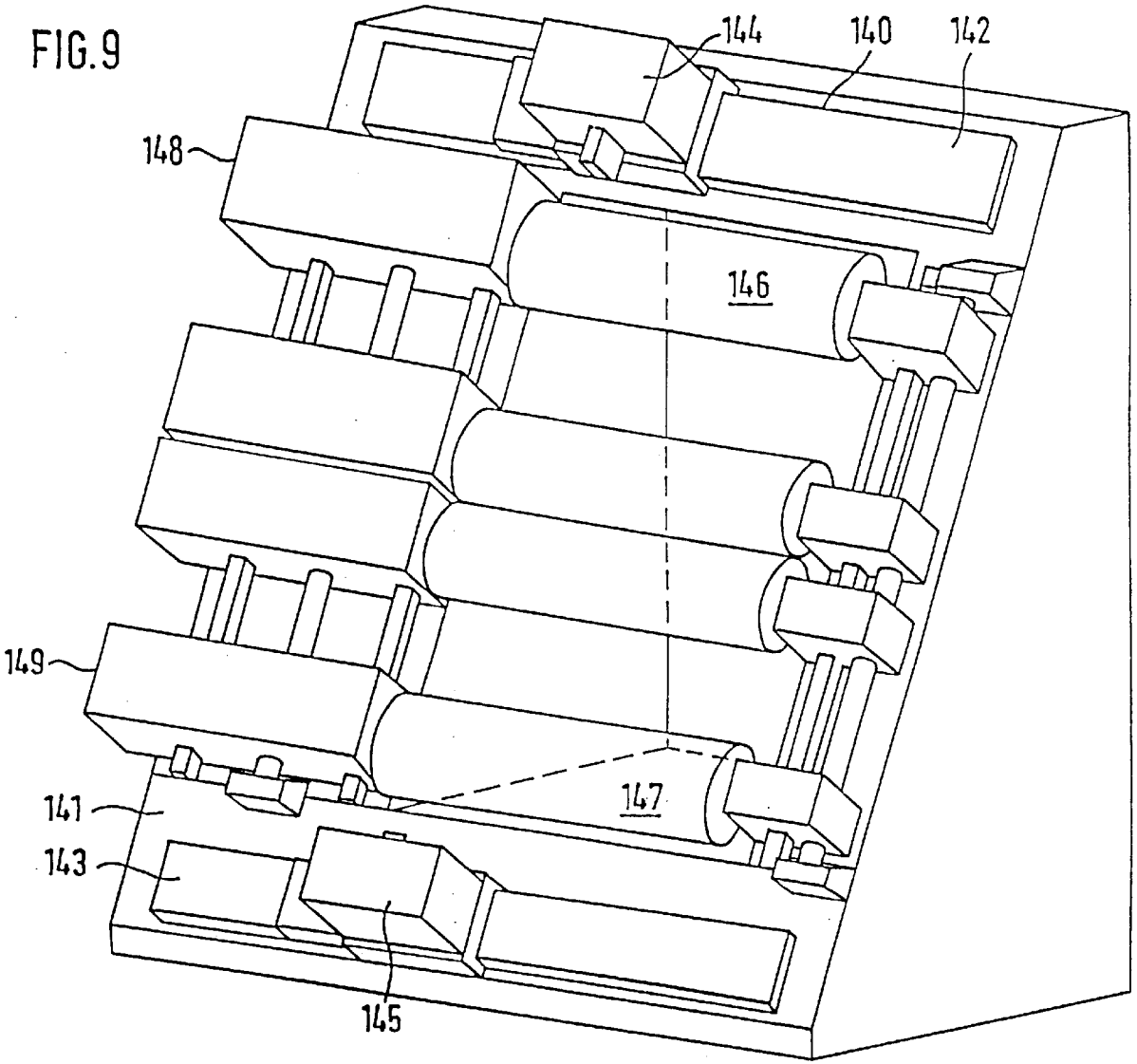
FIG. 9 is a double printing unit with image setting devices in an illustration corresponding to FIG. 3.
Figure 10:
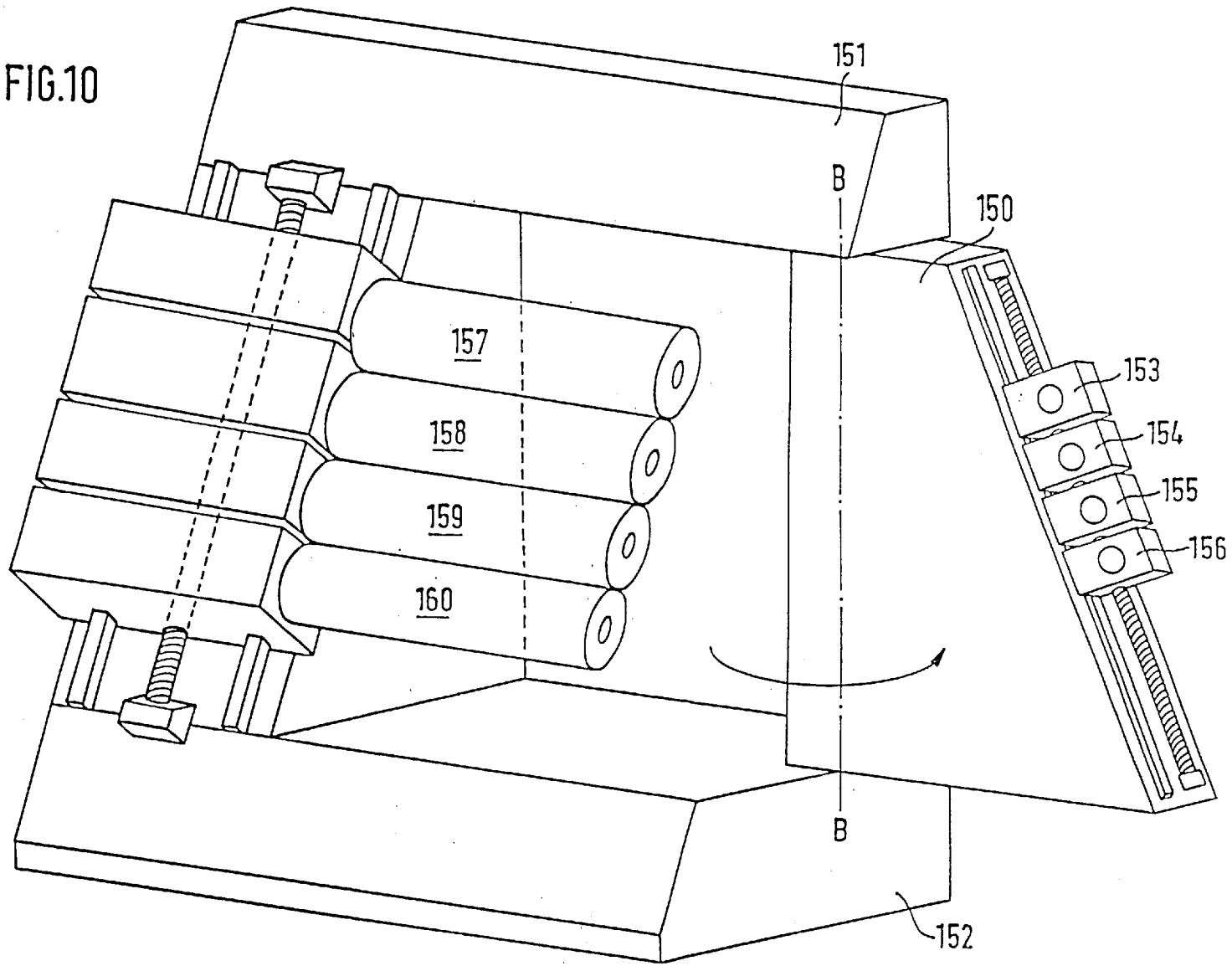
FIG. 10 is a double printing unit in an illustration corresponding to FIG. 3, with a load-bearing wall which can be pivoted out.
Figure 11:
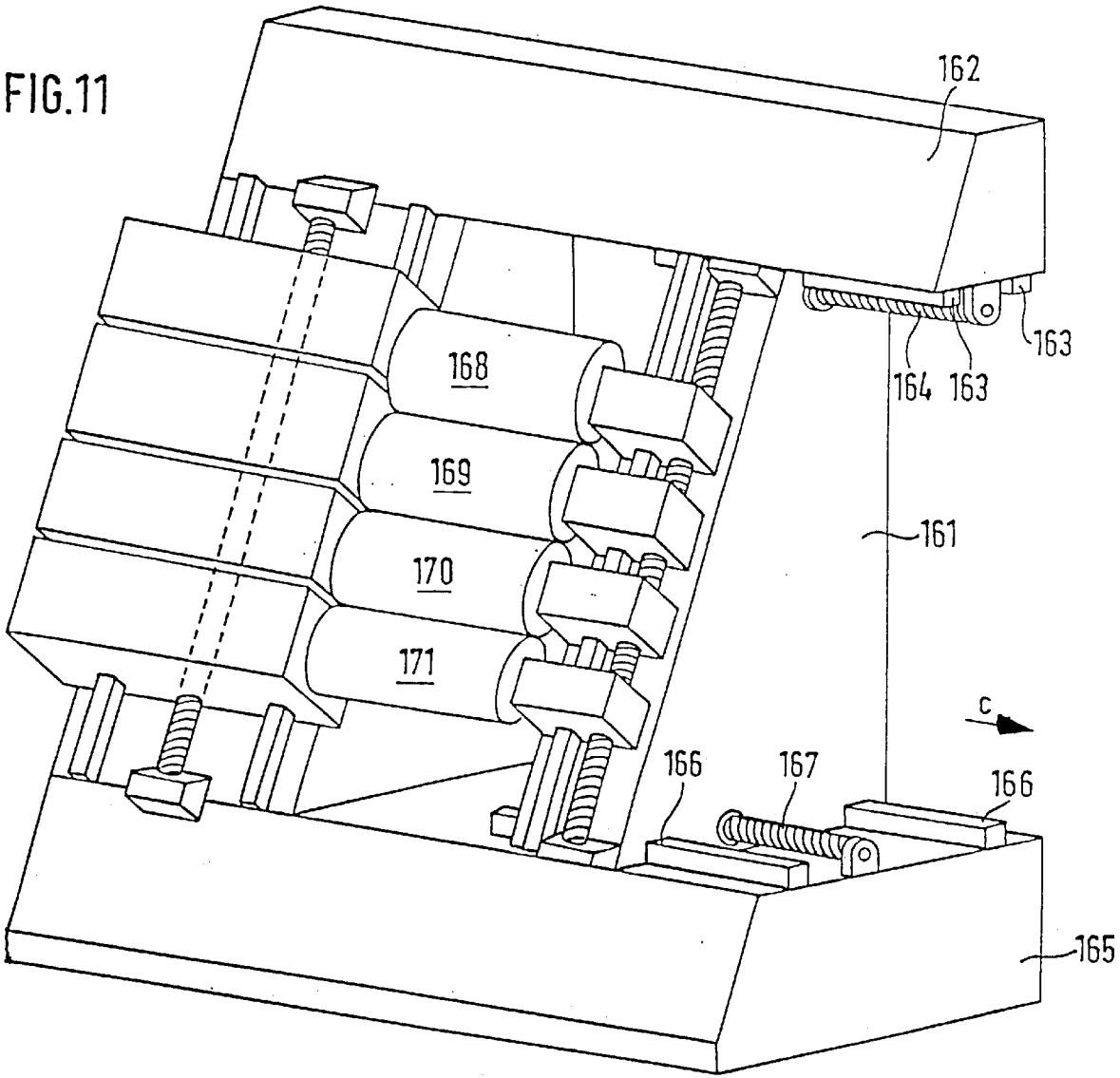
FIG. 11 is a double printing unit corresponding to FIG. 3, with a load-bearing wall which can be displaced.

FIGS. 9 to 11 are based on printing units constructed in principle according to FIG. 3. The parts which agree with this, and their function, are therefore not described again.

In the printing unit according to FIG. 9, each a guide 142, 143 is fitted to the upper connecting piece 140 and to the lower connecting piece 141 of the inclined-bed machine frame. An image-setting device 144 and 145 is displaceably mounted on each guide. The length of the guides 142, 143 is such that the image-setting devices 144, 145 can be moved along the entire length of the printing-unit cylinders 146 and 147, which are designed as plate cylinders. In addition, the guides 142, 143 are lengthened as far as behind the carriages 148, 149, so that the image-setting devices 144, 145 can be transferred into a position in which they are outside the area of the printing-unit cylinders 146, 147. In addition, an erasing device for erasing the image can be provided.

FIG. 10 shows a printing unit having a load bearing wall 150, which is mounted on the connecting pieces 151, 152 such that it can be pivoted about an axis B—B. By this means, one row of the carriages 153 to 156, having truncated-conical, fixed axle journals, can be folded away from the printing-unit cylinders 157 to 160. This offers a further possibility for replacing the printing-unit cylinders 157 to 160 as a whole or for replacing sleeves fitted to the cylinders.

A similar arrangement which serves the same purpose is shown by FIG. 11. Here, one load bearing wall 161 can be displaced in or counter to the direction of the arrow c. For this purpose, guide rails 163 and an guide element designed as a screw spindle 164 are fitted to the upper connecting piece 162. In the same way, guide rails 166 and a guide element designed as a screw spindle 167 are provided on the lower connecting piece 165. Then, for each screw spindle 164, 167, a forward drive means is arranged in the load bearing wall 161, is designed to correspond with the parts 77 to 79 according to FIG. 3 and is therefore not illustrated again. Instead of a threaded rod, any other device explained above for displacing the carriages can also be used to displace the load bearing wall 161.

In order to replace the printing-unit cylinders 168 to 171, the load bearing wall 161 is displaced into its outer end position in the direction of the arrow c. The printing-unit cylinders or sleeves fitted to the latter can then be replaced.

Figure 12:
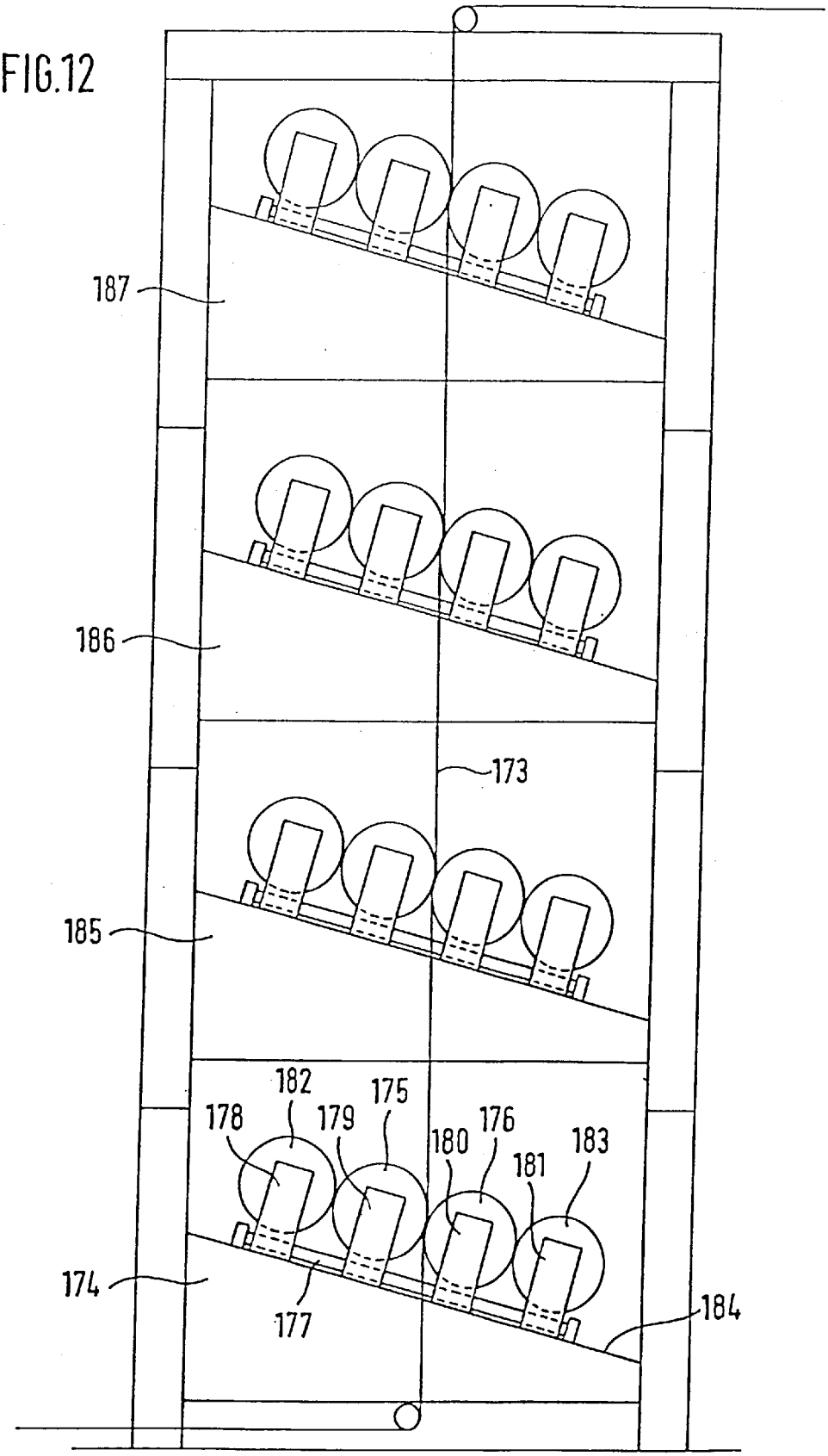
FIG. 12 is a section through a printing-unit tower with vertical web guidance.

FIG. 12 shows a printing-unit tower, through which a printing-material web 173 is guided vertically. For this purpose, provision is made on a horizontally arranged load bearing wall 174 for a guide element 177 which, because of the wrap relationships on the two blanket cylinders 175, 176, is inclined only slightly with respect to the horizontal, on which guide element carriages 178 to 181 for the two blanket cylinders 175, 176 and the two plate cylinders 182, 183 can be moved in an adjustable way. The further elements for guiding and setting the carriages are designed as in the embodiments described above, and are therefore not illustrated again. The rail-like guide elements, which are not illustrated but extend parallel to the guide element 177, are again fitted to one wall 184 of the load bearing wall 174, which runs perpendicular to a plane drawn through the ends of the printing-unit cylinders 175, 176, 182, 183.

As FIG. 12 further shows, in addition a number of horizontal load bearing walls 185 to 187 with the associated printing-unit cylinders can be arranged one above another. A configuration of this type is particularly suitable for printing newspapers and periodicals. If four-color printing on both sides is not desired, it is also possible for two, three or four different printing-material webs to be led through these printing units.

A further advantage of the above-described arrangements is to be seen in the fact that, by using components of identical design, the number of cylinders can be changed flexibly and in a modular way. Thus, for example, printing units have two cylinders for flexographic or direct gravure printing, or printing units having four cylinders for offset or indirect gravure printing can be built up by using standardized components. In addition, there is the possibility of using a four-cylinder printing unit optionally to print a printing-material web on both sides, using indirect printing, or two webs on one side each, using direct printing. In both cases, the outer printing-unit cylinders can bear the printing image, while the two inner printing-unit cylinders can be designed in one case as blanket cylinders transferring the printing image and, in the other case, as impression cylinders, which are then expediently lifted off each other.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of each of the cylinders;

a drive motor corresponding to each cylinder;

at least one guide element operably attached to the load bearing wall so as to extend along a surface of the load bearing wall, the load bearing wall surface being perpendicular to a plane through the end faces of the cylinders; and a plurality of carriages attached to the guide element, at least one of the cylinders being connected to the carriages so that a distance from another of the cylinders can be adjusted.

2. The printing unit according to claim 1, wherein the cylinders are removably mounted and can be exchanged for cylinders of different diameters.

3. The printing unit according to claim 1, further comprising sleeves drawn onto the cylinders, wherein the sleeves may be of varying thickness.

4. The printing unit according to claim 1, wherein the cylinders are cantilever-mounted in the carriages.

5. The printing unit according to claim 1, wherein the at least one load bearing wall is arranged horizontally.

6. The printing unit according to claim 1, wherein the at least one load bearing wall is arranged obliquely with respect to a running direction of a printing-material web.

7. The printing unit according to claim 1, further comprising a plurality of connecting pieces, and two load bearing walls, wherein the load bearing walls are connected to each other at an upper end thereof and a lower end thereof by the connecting pieces to form a portal machine frame.

8. The printing unit according to claim 7, wherein the portal machine frame is an inclined bed machine frame.

9. The printing unit according to claim 7, and further comprising an image-setting device fitted to at least one of the connecting pieces.

10. The printing unit according to claim 9, wherein the image-setting device is displaceable parallel to an axis of the printing-unit cylinders.

11. The printing unit according to claim 1, wherein the at least one load bearing wall has a width approximately equal to a length of the carriages.

12. The printing unit according to claim 1, wherein the guide element is two guide rails.

13. The printing unit according to claim 12, wherein two guide rails are permanently connected to the load bearing wall over their entire length.

14. The printing unit according to claim 1, further comprising a housing in which the carriage is mounted.

15. The printing unit according to claim 1, wherein the guide elements are guide rails, and further comprising:

a rod-like guide element permanently arranged in front of the load bearing wall and parallel to the guide rails; and a forward drive element which is driven and cooperates with the rod like guide element in order to displace the carriage, wherein the forward drive element is mounted on each carriage.

16. The printing unit according to claim 1, wherein four cylinders are provided for offset or indirect gravure printing.

17. The printing unit according to claim 1, wherein four cylinders are provided for flexographic or direct gravure printing.

18. The printing unit according to claim 1, wherein the at least one guide element and the carriages comprise a form fitting carriage guide system.

19. A printing unit for a web fed rotary printing machine, comprising:

at least two cylinders, a position of at least one of the cylinders being adjustable with respect to a position of another of the cylinders;

a machine frame having two load bearing walls arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders; and a plurality of carriages attached to the guide element, at least one of the cylinders being connected to the carriages so that a distance from another of the cylinders can be adjusted, each cylinder being mounted in two carriages, one carriage being at each of two ends of the cylinder.

20. The printing unit according to claim 19, further comprising a setting motor for guiding the carriages on one of the load bearing walls.

21. The printing unit according to claim 19, wherein the drive motors and the setting motors are electric motors.

22. The printing unit according to claim 19, wherein the carriages at one end of the cylinders are tailstocks having an axle journal which can be pulled back in order to mount the cylinders.

23. The printing unit according to claim 19, wherein the carriages at one end of the cylinders have an adjustment travel dimensioned to be greater than at least one of a maximum diameter of an associated sleeve and a maximum diameter of the associated cylinder.

24. The printing unit according to claim 19, wherein one of the two load bearing walls is pivotally attached to the machine frame.

25. The printing unit according to claim 19, wherein one of the two load bearing walls is displaceable on the machine frame in an axial direction of the cylinders. the cylinder.

26. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders; and a plurality of carriages attached to the guide element, at least one of the cylinders being connected to the carriages so that a distance from another of the cylinders can be adjusted, the at least one load bearing wall being arranged vertically.

27. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders;

a plurality of carriages attached to the guide element, at least one of the cylinders being connected to the carriages so that a distance from another of the cylinders can be adjusted, the guide elements being guide rails;

a rod-like guide element permanently arranged in front of the load bearing wall and parallel to the guide rails; and a forward drive element which is driven and cooperates with the rod-like guide element in order to displace the carriage, the forward drive element being mounted on each carriage, the rod-like guide element comprising a screw spindle and the forward drive element comprising a wheel rotatably mounted and axially fixed in the carriage, the wheel having an internal nut thread, the guide element and the drive element together forming a screw drive.

28. The printing unit according to claim 27, wherein the screw drive comprises a ball screw drive.

29. The printing unit according to claim 27, wherein the screw drive comprises a roller screw drive.

30. The printing unit according to claim 27, wherein the screw drive comprises a rolling-ring screw drive.

31. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders;

a plurality of carriages attached to the guide element, at least one of the cylinders being connected to the carriages so that a distance from another of the cylinders can be adjusted, the guide elements being guide rails;

a rod-like guide element permanently arranged in front of the load bearing wall and parallel to the guide rails; and a forward drive element which is driven and cooperates with the rod like guide element in order to displace the carriage, wherein the forward drive element is mounted on each carriage, the rod-guide element comprising a rack and the forward drive element comprising a pinion which together form a rack-and-pinion drive.

32. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders;

a plurality of carriages attached to the guide element, at least one of the cylinders being connected to the carriages so that a distance from another of the cylinders can be adjusted, the guide elements being guide rails;

a rod-like guide element permanently arranged in front of the load bearing wall and parallel to the guide rails; and a forward drive element which is driven and cooperates with the rod like guide element in order to displace the carriage, wherein the forward drive element is mounted on each carriage, the rod-like guide comprising a rail-like stator and the forward drive element comprising a rotor winding permanently fixed to the carriage, which together form a linear motor.

33. A printing unit for a web fed rotary printing machine, comprising:

at least two cylinders, a position of at least one of the cylinders being adjustable with respect to a position of another of the cylinders;

a machine frame having at least one load bearing wall arranged laterally beside an end of the cylinders;

a drive motor corresponding to each cylinder;

at least one guide element operably attached to the load bearing wall at a surface of the load bearing wall, the load bearing wall surface being perpendicular to a plane through the end faces of the cylinders; and a plurality of carriages attached to the guide element, at least one of the cylinders being connected to the carriages so that a distance from another of the cylinders can be adjusted, the at least one guide element and the carriage is comprising a form fitting carriage guide system, the carriages further comprising a plurality of sliding blocks having undercut grooves and the at least one guide element further comprising a T-shaped cross-section, wherein the at least one guide element engages in the undercut grooves of the sliding blocks of the carriages.

* * * * *